US010755693B2

(12) United States Patent
Ekuni

(10) Patent No.: US 10,755,693 B2
(45) Date of Patent: Aug. 25, 2020

(54) ACOUSTIC APPARATUS AND VIBRATION TRANSMISSION METHOD

(71) Applicant: YAMAHA CORPORATION, Hamamatsu-shi (JP)

(72) Inventor: Shingo Ekuni, Tarzana, CA (US)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/396,843

(22) Filed: Apr. 29, 2019

(65) Prior Publication Data

US 2019/0251949 A1 Aug. 15, 2019

Related U.S. Application Data

(63) Continuation of application No. PCT/JP2017/038402, filed on Oct. 24, 2017.

(30) Foreign Application Priority Data

Nov. 7, 2016 (JP) ..... 2016-217154

(51) Int. Cl.
*G10K 15/10* (2006.01)
*H04R 1/02* (2006.01)
(Continued)

(52) U.S. Cl.
CPC ..... *G10K 15/10* (2013.01); *G10K 11/18* (2013.01); *G10K 15/00* (2013.01); *G10K 15/04* (2013.01);
(Continued)

(58) Field of Classification Search
CPC ..... H04R 17/00; H04R 7/04; H04R 2440/05
(Continued)

(56) References Cited

U.S. PATENT DOCUMENTS 7,155,021 B2 * 12/2006 Corynen ..... H04R 7/045 381/152
8,170,243 B2 5/2012 Kondo et al.
(Continued)

FOREIGN PATENT DOCUMENTS

JP S6221479 A 1/1987
JP 2002090887 A 3/2002
(Continued)

OTHER PUBLICATIONS

International Search Report issued in Intl. Appln. No. PCT/JP2017/038402 dated Jan. 16, 2018. English translation provided.
(Continued)

*Primary Examiner* — Alexander Krzystan
(74) *Attorney, Agent, or Firm* — Rossi, Kimms & McDowell LLP

(57) ABSTRACT

Provided is an acoustic apparatus capable of causing a sensation that a sound is produced in a larger space than reality, without requiring an excessive cost and time-consuming installation. The sound collected by a microphone is converted to an electrical signal, and a reflected sound component is extracted by a signal processing portion. The reflected sound component thus extracted is amplified by an amplifier, and the reflected sound component thus amplified vibrates transducers attached to a back-side board surface of each acoustic structure, whereby reflected sound is emitted from all faces including front-side board surface and the back-side board surface. A player can thus naturally perceive as if the space where he stays is expanded.

12 Claims, 7 Drawing Sheets

(51) Int. Cl.

| | |
|---|---|
| ***H04R 3/12*** | (2006.01) |
| ***H04R 1/40*** | (2006.01) |
| ***H04R 1/00*** | (2006.01) |
| ***G10K 11/18*** | (2006.01) |
| ***G10K 15/04*** | (2006.01) |
| ***G10K 15/08*** | (2006.01) |
| ***G10K 15/00*** | (2006.01) |

(52) U.S. Cl.
CPC ..... *G10K 15/08* (2013.01); *H04R 1/00* (2013.01); *H04R 1/025* (2013.01); *H04R 1/403* (2013.01); *H04R 3/12* (2013.01); *H04R 2201/028* (2013.01)

(58) Field of Classification Search
USPC ..... 381/152, 337, 162, 63, 64
See application file for complete search history.

(56) References Cited

U.S. PATENT DOCUMENTS

| | | | | |
|---|---|---|---|---|
| 9,621,994 | B1 * | 4/2017 | Bongiovi | H04R 9/043 |
| 2008/0137881 | A1 * | 6/2008 | Bongiovi | H04R 1/005 381/86 |
| 2013/0126268 | A1 * | 5/2013 | Honji | E04B 1/8209 181/284 |
| 2013/0223658 | A1 * | 8/2013 | Betlehem | H04R 5/02 381/307 |

FOREIGN PATENT DOCUMENTS

| | | | |
|---|---|---|---|
| JP | 2003125475 | A | 4/2003 |
| JP | 2008203560 | A | 9/2008 |
| JP | 2008268251 | A | 11/2008 |
| JP | 2009163141 | A | 7/2009 |
| JP | 2009225034 | A | 10/2009 |
| JP | 2012198407 | A | 10/2012 |
| JP | 2016058936 | A | 4/2016 |

OTHER PUBLICATIONS

Written Opinion issued in Intl. Appln. No. PCT/JP2017/038402 dated Jan. 16, 2018. English translation provided.
Office Action issued in Japanese Appln. No. 2016-217154 dated Jul. 16, 2019. English translation provided.

* cited by examiner

ACOUSTIC APPARATUS AND VIBRATION TRANSMISSION METHOD

BACKGROUND OF THE INVENTION

The present invention relates to an acoustic apparatus and a vibration transmission method.

DESCRIPTION OF THE RELATED ART

An acoustic apparatus has been conventionally known provided with: a plurality of microphones; an electronic microphone rotator (EMR) that outputs sound collected from each microphone with sequential switching; a finite impulse response (FIR) filter that adds reflected sound to a collected sound signal that is output from the EMR; an equalizer; an amplifier; and a plurality of speakers in a room. Each speaker is provided with the FIR filter, the equalizer, and the amplifier. The signal to which the reflected sound has been added by the FIR filter is output from each speaker through the equalizer and the amplifier. The signal is subjected again to sound collection by each microphone. The aforementioned operation is repeated. Thus, a reverberation time period is extended and a level of initial reflected sound is enhanced. As a result, a listener can perceive as if the sound is produced in a larger space than an actual space.

PRIOR ART DOCUMENTS

Patent Documents

Patent Document 1: Japanese Unexamined Patent Application, Publication No. 2008-268251

SUMMARY OF THE INVENTION

Problems to be Solved by the Invention

The conventional acoustic apparatus described above requires installation of the plurality of microphones and the plurality of speakers, and the FIR filter, the equalizer, and the amplifier provided to each of the speakers. The conventional acoustic apparatus therefore has a disadvantage of an extremely high cost.

In addition, in the conventional acoustic apparatus, each speaker needs to be installed according to an emission characteristic thereof calculated beforehand. Thus, the conventional acoustic apparatus has another disadvantage that installation of the entire apparatus requires expertise and is time-consuming.

The present invention has been made in view of the aforementioned disadvantages, and an object of the present invention is to provide an acoustic apparatus and a vibration transmission method by which a listener can perceive as if sound is produced in a larger space than an actual space, without requiring a high cost and time-consuming installation.

Means for Solving the Problems

The acoustic apparatus according to one aspect of the present invention includes: a signal acquisition portion that acquires a signal that is at least one of a sound signal and a vibration signal generated by a sound source; a signal processing portion that subjects the signal acquired by the signal acquisition portion to a predetermined signal processing; an acoustic structure having a plate-like shape and comprising thereinside at least one cavity that extends in one direction; and a vibration generation portion that is attached to the acoustic structure, in which the vibration generation portion generates vibration corresponding to the signal acquired by the signal acquisition portion and transmits the vibration generated to the acoustic structure, and the acoustic structure emits sound through transmission of the vibration from the vibration generation portion.

The vibration transmission method according to another aspect of the present invention includes:

- acquiring a signal that is at least one of a sound signal and a vibration signal generated by a sound source;
- subjecting the signal acquired to a predetermined signal processing;
- generating vibration corresponding to the signal having been subjected to the predetermined signal processing; and
- transmitting the vibration generated to an acoustic structure having a plate-like shape and comprising thereinside at least one cavity that extends in one direction.

DESCRIPTION OF EMBODIMENTS

Figure 1:
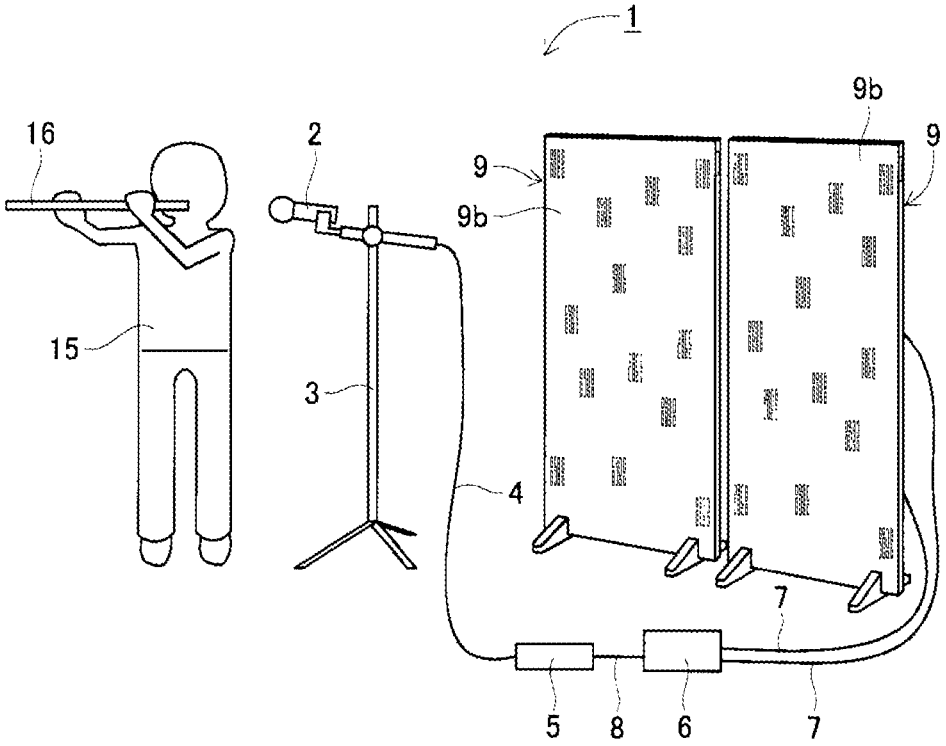
FIG. 1 is an explanatory diagram showing a configuration of an acoustic apparatus according to one embodiment of the present invention.

The acoustic apparatus according to the one aspect of the present invention includes: a signal acquisition portion that acquires a signal that is at least one of a sound signal and a vibration signal both generated by a sound source; a signal processing portion that subjects the signal acquired by the signal acquisition portion to a predetermined signal processing; an acoustic structure having a plate-like shape and comprising thereinside at least one cavity that extends in one direction; and a vibration generation portion that is attached to the acoustic structure, in which the vibration generation portion generates vibration corresponding to the signal acquired by the signal acquisition portion and transmits the vibration generated to the acoustic structure, and the acoustic structure emits sound through transmission of the vibration from the vibration generation portion.

The vibration transmission method according to the another aspect of the present invention includes: acquiring a signal that is at least one of a sound signal and a vibration signal generated by a sound source; subjecting the signal acquired to a predetermined signal processing; generating vibration corresponding to the signal having been subjected to the predetermined signal processing; and transmitting the vibration generated to an acoustic structure having a plate-like shape and comprising thereinside at least one cavity that extends in one direction.

Examples of the sound signal include: signals representing sounds emitted from musical instruments, speakers, and humans; signals representing sounds generated in daily life and natural environment; musical sound signals output from output terminals of electronic musical instruments; musical sound signals output from output terminals of music reproduction devices such as an audio device, a portable music player, etc. Examples of the vibration signal include: signals representing vibrations of musical instruments such as vibrations of strings of stringed instruments and vibrations of drums. The signal acquisition portion is represented by: a microphone that collects the sound signals; a pickup such as a piezoelectric element that detects the vibration signals; a female jack (connector) that receives the signals output from the output terminals, the microphone and the pickup; and the like.

In the acoustic apparatus, through transmission of the vibration from the vibration generation portion to the acoustic structure, the acoustic structure vibrates to emit from all faces thereof sound corresponding to the signal. Accordingly, in regard to the sound emitted from the acoustic apparatus, it is more difficult to identify the emission direction, compared to sound emitted from point-like structures such as a speaker. A listener of the sound emitted from the acoustic structure can thus naturally perceive as if the space where he stays is expanded.

The acoustic apparatus is capable of causing a sensation that a sound is produced in a larger space than an actual space, merely by installing the signal acquisition portion, the signal processing portion, the acoustic structure and the vibration generation portion, each singly. Therefore, the installation cost is reduced compared to a case of using a plurality of speakers, etc. for producing a similar effect. In addition, since no calculation of the emission characteristic of the speakers is necessary, the installation does not require expertise and is not time-consuming. In other words, the acoustic apparatus is capable of causing a sensation that a sound is produced in a larger space than an actual space, without requiring an excessive cost and time-consuming installation.

It is preferred that the acoustic structure includes at least one opening that communicates the cavity with an outer space.

It is preferred that the vibration generation portion transmits the vibration to a position corresponding to a node of a vibration mode of the acoustic structure, on an outer face of the acoustic structure.

Such a configuration enables a reduction in irregularity of the frequency characteristic of the sound emitted from the acoustic structure, and eventually a natural reverberation effect.

It is preferred that the vibration generation portion transmits the vibration to a position corresponding to an antinode of a vibration mode of the acoustic structure, on an outer face of the acoustic structure.

Such a configuration enables an increase in efficiency in transmission of the vibration from the vibration generation portion to a board surface of the acoustic structure, and eventually an increase in volume of the sound emitted from the acoustic structure.

It is preferred that the acoustic structure includes the cavity in a plurality of number.

Such a configuration enables a reduction in irregularity of the frequency characteristic of the reverberant sound emitted from the acoustic structure, compared to an acoustic structure including only one cavity.

It is preferred that the predetermined signal processing extracts at least a part of a signal corresponding to a reflected sound component from the signal acquired, or generates a signal corresponding to the reflected sound component.

Such a configuration enables the acoustic structure to emit sound corresponding to the reflected sound component to produce a reverberation effect, and eventually a listener can thus naturally perceive as if the space where he stays is expanded.

It is preferred that the predetermined signal processing adjusts a ratio between a signal corresponding to a reflected sound component and a signal corresponding to a direct sound component, of the signal acquired. In addition, it is preferred that the predetermined signal processing adjusts a reverberation time period of reverberant sound composed of a reflected sound component of the signal acquired. Such processing enables, for example, extraction of only the reflected sound component, or generation of the reflected sound component. In addition, a level of the reverberation effect and a length of the reverberation time period are enabled to be adjusted according to the preferences of a player or audience.

Constitution of Acoustic Apparatus 1

The constitution of an acoustic apparatus 1 according to one embodiment (may be also referred to as "first embodiment") of the present invention will be described hereinafter with reference to FIG. 1.

As shown in FIG. 1, the acoustic apparatus 1 includes: a microphone 2 that collects sound generated by a sound source and converts the sound to an electrical signal (acquires a sound signal); a signal processing portion 5 that extracts at least a part of a reflected sound component from the electrical signal obtained through conversion by the microphone 2 or generates an reflected sound component; an amplifier 6 that amplifies the reflected sound component extracted by the signal processing portion 5; two acoustic structures 9, 9 that each include thereinside at least one cavity; and two transducers (designated by reference numeral 10 in FIG. 3) that are respectively attached to the acoustic structures 9. The microphone 2 is mounted on a microphone stand 3 and electrically connected to the signal processing portion 5 through a microphone cable 4. The signal processing portion 5 is electrically connected to the amplifier 6 through a connection cord 8, and the amplifier 6 is electrically connected to the transducers 10 through output cables 7, 7. The microphone 2 is a type of the signal acquisition portion, while the transducer 10 is a type of the vibration generation portion.

Constitution of Acoustic Structure 9

The constitution of the acoustic structure 9 will be described hereinafter with reference to FIGS. 2 to 5.

Figure 2:
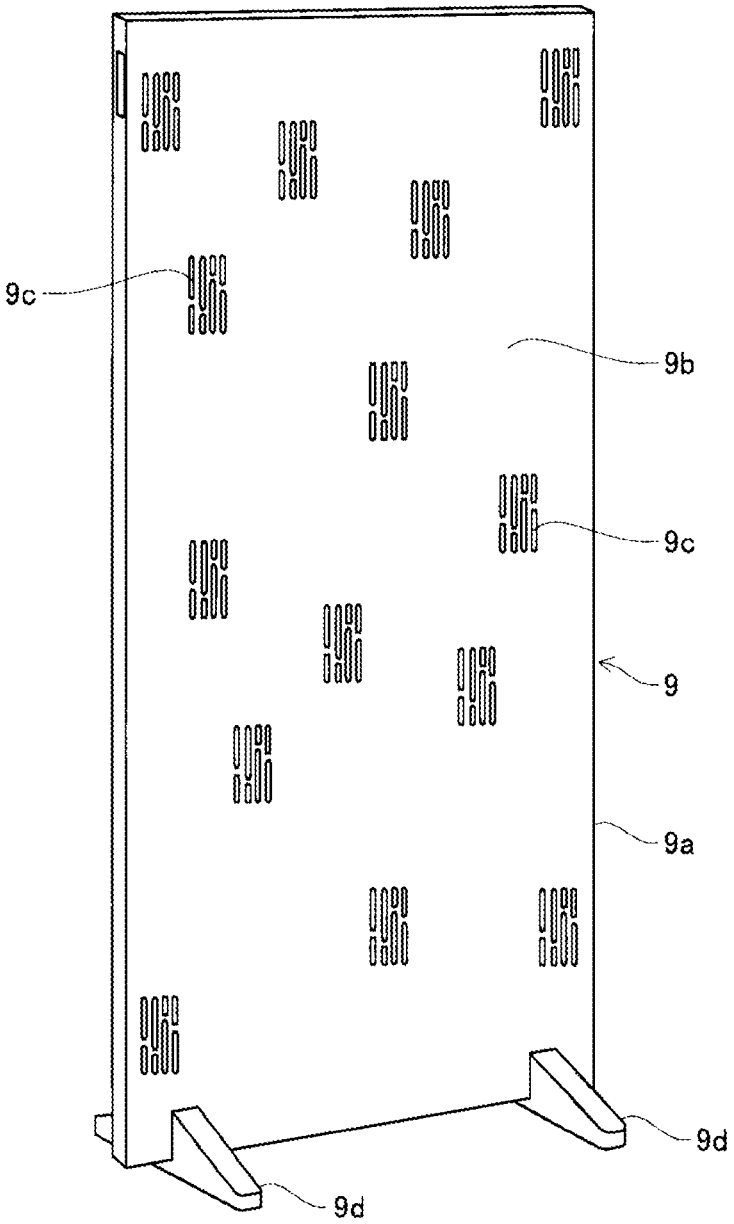
FIG. 2 is a perspective view showing an acoustic structure provided in the acoustic apparatus shown in FIG. 1 seen from a front side.
Figure 3:
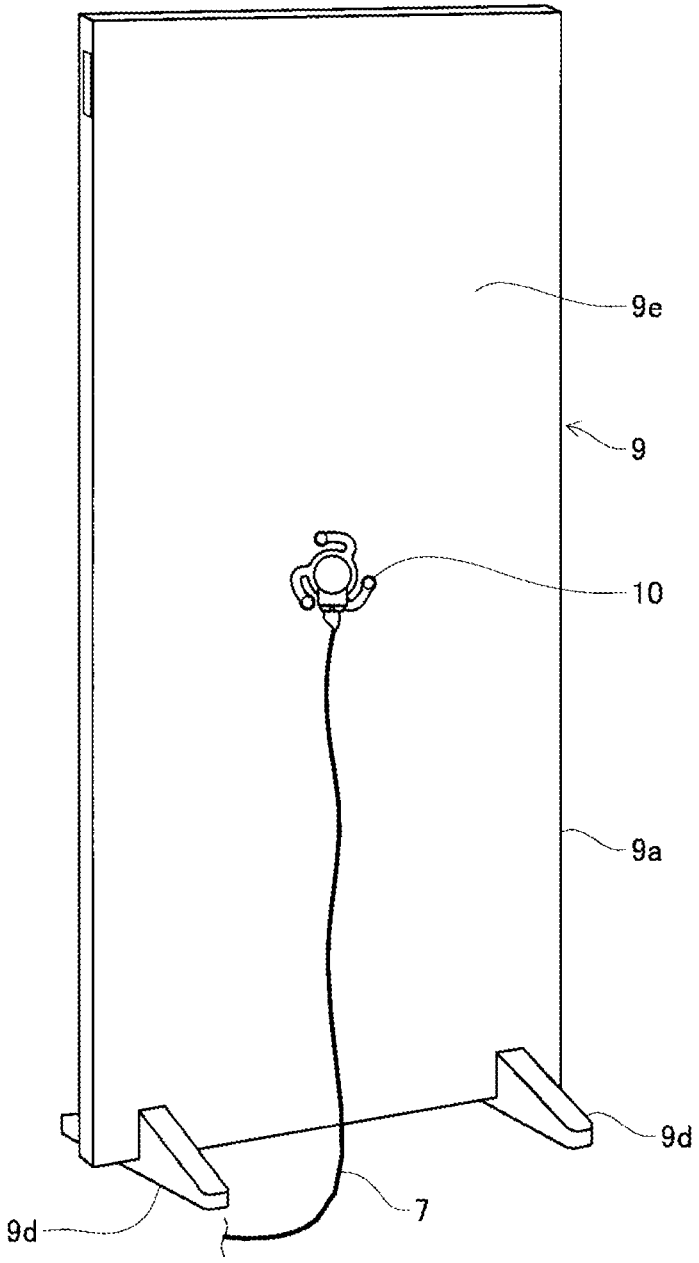
FIG. 3 is a perspective view showing the acoustic structure shown in FIG. 2 seen from a back side.
Figure 4:
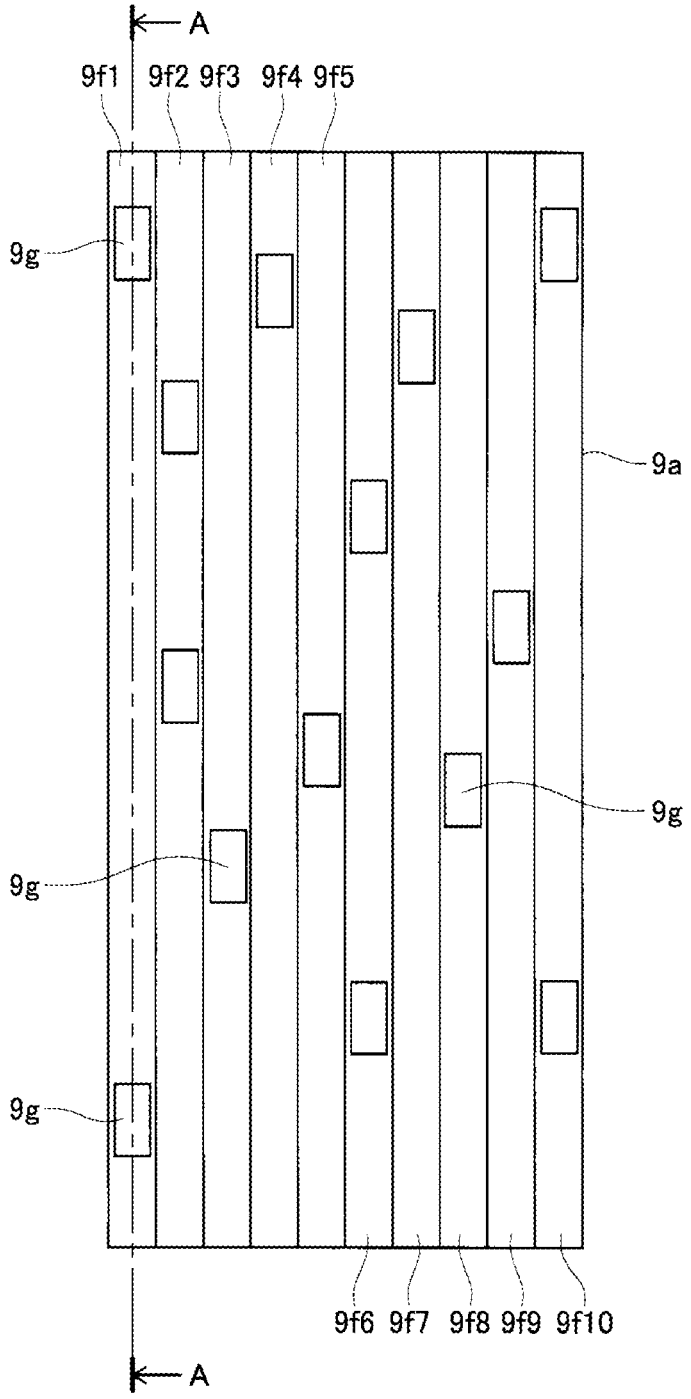
FIG. 4 is a plan view showing an internal constitution of the acoustic structure shown in FIG. 1.
Figure 5:
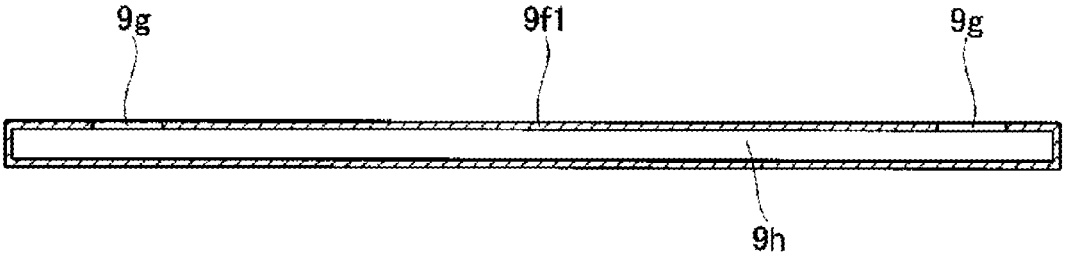
FIG. 5 is a cross sectional view taken along an A-A line in FIG. 4.

FIG. 2 is a perspective view showing the acoustic structure 9 provided in the acoustic apparatus 1 shown in FIG. 1 seen from a front side; FIG. 3 is a perspective view showing the acoustic structure 9 shown in FIG. 2 seen from a back side; FIG. 4 is a plan view showing an internal constitution of the acoustic structure 9 shown in FIG. 1; and FIG. 5 is a cross sectional view taken along an A-A line in FIG. 4.

As shown in FIGS. 2 and 3, the acoustic structure 9 is provided with: an acoustic structure main body 9*a* formed to have a vertically long planar shape; and a pair of stands 9*d*, 9*d* that support both sides of a lower end of the acoustic structure main body 9*a*. Front and back faces, both lateral faces, and upper and bottom faces, i.e., external faces, of the acoustic structure main body 9*a* are constituted of wood boards. As shown in FIG. 2, on a front-side board surface 9*b*, a plurality of slit groups 9*c* each composed of a plurality of vertically long slits having different lengths. As shown in FIG. 3, the transducer 10 is attached at the center of a diagonal on a back-side board surface 9*e* of the acoustic structure main body 9*a*.

As shown in FIG. 4, ten hollow members 9*f*1 to 9*f*10 are provided inside the acoustic structure main body 9*a*. Each of the hollow members 9*f*1 to 9*f*10 is in a vertically long cuboidal shape and hollow, i.e., has a cavity (designated by reference numeral 9*h* in FIG. 5) thereinside. Adjacent hollow members are in close contact and fixed with each other at lateral faces thereof in a longitudinal direction. Each of the hollow members 9*f*1 to 9*f*10 is provided with, on a front face thereof, one or two opening(s) 9*g* that communicate(s) the cavity 9*h* with an outer space. For example, as shown in FIG. 5, two openings 9*g* are provided in the vicinity of an upper end and in the vicinity of a lower end, respectively, of the front face of the hollow member 9*f*1. An aperture of each opening 9*g* is covered with a net (not illustrated) for preventing dust from entering. Positions of the slit groups 9*c* correspond to positions of the openings 9*g*, respectively.

The acoustic structure 9 generates modal vibration. Twice the height of the acoustic structure 9 corresponds to one wavelength of the modal vibration. The stands 9*d*, 9*d* serve as mechanical grounding members that dissipate the vibration. When the modal vibration is generated, a point of the greatest amplitude as generally referred to a vibration antinode, and a point of the smallest amplitude as generally referred to a vibration node are found in the audio structure 9. Positions of the antinodes and nodes of the vibration vary depending on: the length, the number, the shape and the material of the hollow members 9*f*1 to 9*f*10 constituting the acoustic structure main body 9*a*; the shape, the position and the number of the openings 9*g*; and the like.

In the present embodiment, since the acoustic structure main body 9*a* has ten hollow members, i.e., a plurality of cavities 9*h*, thereinside, a reduction in irregularity of the frequency characteristic of the reverberant sound emitted from the acoustic structure 9 is enabled, compared to an acoustic structure including only one cavity. In addition, the center of a diagonal on the back-side board surface 9*e* of the acoustic structure main body 9*a* corresponds to the vibration antinode, at which the transducer 10 is attached. Owing to the transmission of the vibration of the transducer 10 to a site corresponding to the vibration antinode, improvement in efficiency in transmission of the vibration from the transducer 10 to the acoustic structure 9, and eventually an increase in the volume of the reverberant sound emitted from the acoustic structure 9, are enabled.

The acoustic structure 9 thus enables a reduction in irregularity of the frequency characteristic of the reverberant sound emitted therefrom, compared to an acoustic structure including only one cavity. In addition, the acoustic structure 9 enables an increase in the volume of the reverberant sound emitted therefrom, compared to an acoustic structure in which the vibration of the transducer 10 is transmitted to a site corresponding to the vibration node.

In the present embodiment, the acoustic structure main body 9*a* is in a vertically long cuboidal shape of 120 cm in height, 60 cm in width, and 28 mm in thickness; however, the acoustic structure main body 9*a* may be in a desired size according to an intended usage. At the same time, the acoustic structure main body 9*a* is formed from a molded board of woody fiber as generally referred to a medium density fiberboard (MDF) to be hollow and planar, and includes the hollow members 9*f*1 to 9*f*10 thereinside. The hollow members 9*f*1 to 9*f*10 are each formed from a material having relatively high rigidity such as an acrylic resin. The acoustic structure 9 thus has improved responsiveness to the vibration transmitted from the transducer 10. As a result, a high-frequency range of the emitted reverberant sound persists longer, whereby a sensation of expanse is enabled to be naturally produced.

Constitution of Transducer 10

The constitution of the transducer 10 will be described hereinafter with reference to FIG. 6.

Figure 6:
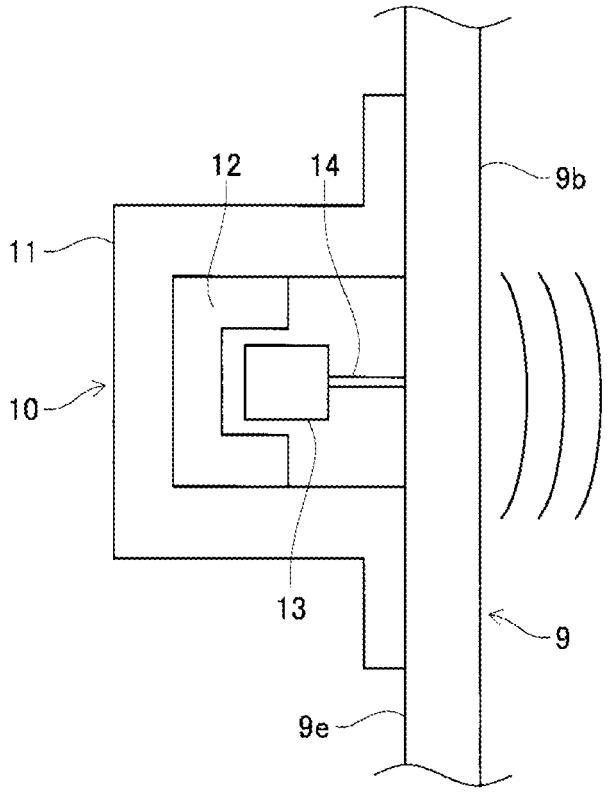
FIG. 6 is an explanatory diagram schematically showing a constitution of a transducer attached to the acoustic structure shown in FIG. 1.

FIG. 6 is an explanatory diagram schematically showing a constitution of the transducer attached to the acoustic structure shown in FIG. 1.

The transducer 10 includes: a housing 11 that is attached to the back-side board surface 9*e* of the acoustic structure 9; a permanent magnet 12 provided inside the housing 11; a voice coil which is cylindrical and at least partially surrounded by the permanent magnet 12; and a movable member 14 attached to a front end of the voice coil 13. The voice coil 13 is electrically connected to the amplifier 6 through the output cable 7 shown in FIG. 1. When the reflected sound component amplified by the amplifier 6 is input to the voice coil 13, the voice coil 13 oscillates back and forth. As a result, the movable member 14 attached to the front end of the voice coil 13 vibrates the back-side board surface 9*e* of the acoustic structure 9. Consequently, sound corresponding to the reflected sound component is emitted from all faces including the entire front-side board surface 9*b* and the entire back-side board surface 9*e* of the acoustic structure 9.

Operation of Acoustic Apparatus 1

The operation of the acoustic apparatus 1 will be described hereinafter with reference to FIGS. 1 and 7.

Figure 7:
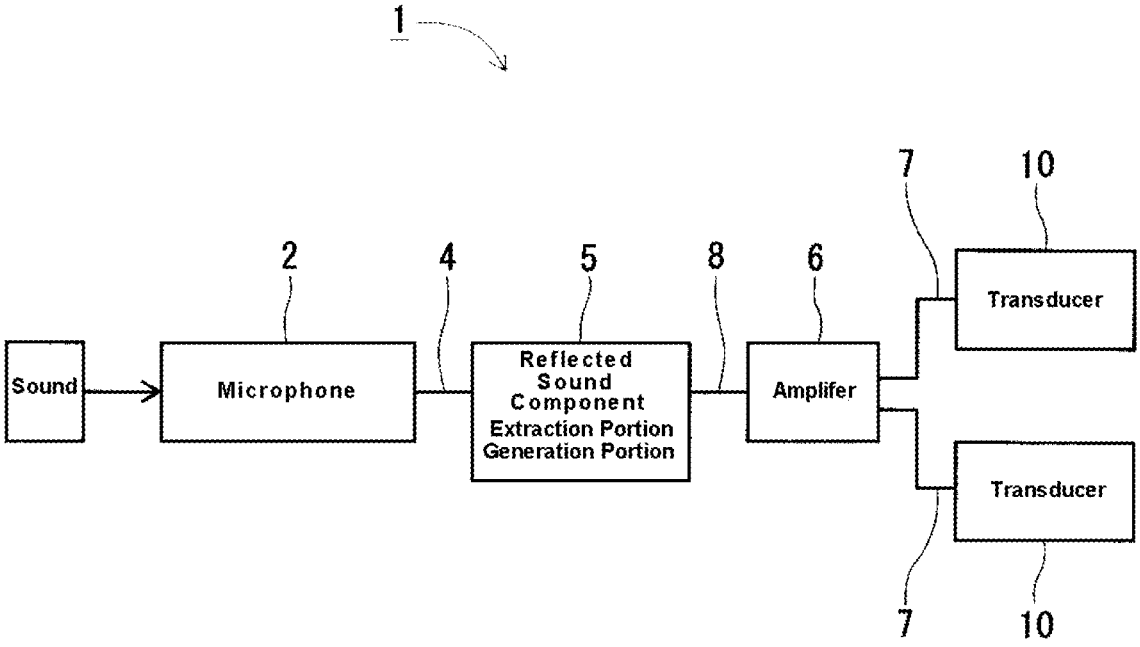
FIG. 7 is a block diagram showing an essential part of an electrical configuration of the acoustic apparatus shown in FIG. 1.

FIG. 7 is a block diagram showing a principal electrical configuration of the acoustic apparatus shown in FIG. 1.

As shown in FIG. 1, the present embodiment is directed to a case in which a player 15 plays a flute 16. The microphone 2 is installed in front of the player 15, while two acoustic structures 9, 9 are installed in parallel behind the microphone 2. The front-side board surface 9*b* of each acoustic structure 9 is directed to the player 15. When the player 15 plays the flute 16, sound (sound signal) emitted from the flute 16 (sound source) is collected by the microphone 2. The sound collected by the microphone 2 includes direct sound that directly reaches the microphone 2 from the flute 16, and reflected sound reflected by walls, etc. of a room in which the player 15 plays. The microphone 2 converts the collected sound to an electrical signal, and outputs the electrical signal obtained through conversion to the signal processing portion 5. The signal processing portion 5 analyzes the electrical signal being input and extracts a reflected sound (wet) component. The signal processing portion 5 also generates the reflected sound (wet) component. It is to be noted that in FIG. 7, the signal processing portion 5 is referred to as "Reflected Sound Component Extraction/Generation Portion", citing the principal operations (extraction and generation of the reflected sound component) of the signal processing portion 5.

The signal processing portion 5 has a function of adjusting a ratio of the reflected sound (wet) component to be extracted and a direct sound (dry) component. Owing to this function, only the reflected sound component may be extracted, for example. The signal processing portion 5 also has a function of adjusting a reverberation time period of the reverberant sound produced by the reflected sound (wet) component. The signal processing portion 5 also has a function of generating the reflected sound (wet) component.

This function generates, from all of the signals acquired by the microphone 2, the reflected sound (wet) components through filtration. For the filtration, filters such as a reverb filter and a delay filter may be used, for example. The signal processing portion 5 also has a function of adjusting a ratio of sound levels of the components. In this function, for example, the sound level (dB) of the signal acquired by the microphone 2 is measured beforehand, and the sound level is defined as 100%. Subsequently, the dry component and the wet component mixed at a predetermined ratio (for example, 70% dry and 30% wet) may be submitted to the amplifier 6. By means of these functions, a size of the reverberation effect and a length of the reverberation time period are enabled to be adjusted according to the preferences of the player 15 or the audience.

Furthermore, depending on an installation position of the microphone 2, for example at an upper end of the acoustic structure 9, feedback may be caused. In such a case, the feedback may be avoided by increasing the proportion of the reflected sound (wet) component and reducing the proportion of the direct sound (dry) component.

The signal processing portion 5 outputs to the amplifier 6 the reflected sound (wet) component being extracted. The amplifier 6 amplifies the reflected sound (wet) component being input and outputs to each transducer 10. Subsequently, each transducer 10 generates vibration corresponding to the reflected sound (wet) component being input, and transmits the vibration to the back-side board surface 9*e* of each acoustic structure 9 (FIG. 6). Then, each acoustic structure 9 vibrates in response to the vibration transmitted from the transducer 10. Each acoustic structure 9 emits sound corresponding to the reflected sound (wet) component, from all faces including the entire front-side board surface 9*b* (FIG. 1) and the entire back-side board surface 9*e*. In other words, each acoustic structure 9 emits natural reverberant sound.

Thus, the player 15 directly hears sound produced by the flute 16 he is playing, while hearing the reverberant sound emitted from each acoustic structure 9. As a result, the player 15 perceives as if he is playing the flute in a larger space than the room in which he actually stays. For example, even in a case in which the player 15 plays in a small room having a floor area of approximately 7 $m^2$ to 10 $m^2$, the player can play as comfortably as in a concert hall.

The acoustic apparatus 1 enables the following vibration transmission method to be practiced, the method including: acquiring a signal that is at least one of a sound signal and a vibration signal generated by a sound source; subjecting the signal acquired to a predetermined signal processing; generating vibration corresponding to the signal having been subjected to the predetermined signal processing; and transmitting the vibration generated to an acoustic structure having a plate-like shape and comprising thereinside at least one cavity that extends in one direction.

Effects of First Embodiment (1) According to the acoustic apparatus 1 of the first embodiment described above, the acoustic structure 9 emits sound corresponding to the reflected sound component, from all faces including the entire front-side board surface 9*b* and the entire back-side board surface 9*e*, whereby the reverberation effect is produced. Therefore, it is more difficult to identify the emission direction, compared to an apparatus that emits sound from point-like structures such as a speaker.

A listener of the sound emitted from the acoustic structure 9 can thus naturally perceive as if the space where he stays is expanded.

(2) The transducer 10 is attached so as to transmit vibration to a position corresponding to an antinode of a vibration mode of the acoustic structure 9, on the back-side board surface 9*e* of the acoustic structure 9. The acoustic structure main body 9*a* constituting the acoustic structure 9 includes thereinside the plurality of hollow members 9*f*1 to 9*f*10.

An improvement in efficiency in transmission of the vibration from the transducer 10 to the acoustic structure 9 is thus enabled. The volume of the sound emitted from the acoustic structure 9 is thus enabled to be increased. The acoustic structure 9 enables a reduction in irregularity of the frequency characteristic of the sound emitted therefrom, compared to an acoustic structure including only one cavity.

(3) As set forth above, the acoustic apparatus 1 is capable of causing a sensation that a sound is produced in a larger space than an actual space, merely by installing the microphone 2, the signal processing portion 5 and the amplifier 6 each singly, as well as two acoustic structures 9 and two transducers 10. The reduction of cost is thus enabled.

In addition, unlike the conventional apparatus, since no calculation of the emission characteristic is necessary, the installation does not require expertise and is not time-consuming.

In other words, the acoustic apparatus 1 of the aforementioned embodiment is capable of causing a sensation that a sound is produced in a larger space than an actual space, without requiring an excessive cost and time-consuming installation.

Other Embodiments (1) The transducer 10 may also be attached so as to transmit vibration to a position corresponding to a node of a vibration mode of the acoustic structure 9, on the back-side board surface 9*e* of the acoustic structure 9. This configuration enables a further reduction in irregularity of the frequency characteristic of the sound emitted from the acoustic structure 9.

(2) When the acoustic apparatus 1 is installed in a practice room for a school orchestra, practice with a sensation of playing in a large concert hall is enabled.

Therefore, the orchestra can practice in preparation for a contest, as if they are playing in a large concert hall used for the contest. On the actual contest stage, a negative impact on the performance due to an unfamiliar feeling of reverberant sound and the like can thus be prevented.

(3) When the acoustic apparatus 1 is installed in a conference room, a talker's voice can be brought to all participants.

(4) The acoustic apparatus may also be configured such that video is projected onto the front-side board surface 9*b* of the acoustic structure 9 from which the reverberant sound is emitted. In this configuration, an atmosphere of watching the video while listening to sound in a large space can be produced. For example, during projection mapping, video can be projected to the front-side board surface 9*b* of the acoustic structure 9.

(5) The acoustic structure 9 may be formed from a synthetic resin or a metal in place of a woody material such as the MDF. The acoustic structure 9 may also be used in a state of being suspended from a ceiling or a wall. Alternatively, only one, or three or more of the acoustic structure(s) 9 can be used. When the plurality of acoustic structures 9 are used, a desired arrangement may be employed.

(6) In accordance with an internal constitution of the acoustic structure main body 9*a*, a plurality of transducers 10 may also be attached to the back-side board surface 9*e*.

(7) In the aforementioned embodiment, the sound source is a musical instrument that produces sound (sound signal); however, the sound source may also be a stringed instrument such as an electric guitar and an acoustic guitar that generates vibrations of strings (vibration signal), or a percussion such as a drum that generates vibration of a drumhead (vibration signal). The vibration signal may be acquired by a pickup such as a piezoelectric element, and then output to the signal processing portion 5, which carries out processing of all types of effectors such as an equalizer, a compressor, and the like. The "equalizer" as referred to means an effector that amplifies or diminishes only a particular frequency component. The "compressor" as referred to means an effector that compresses an amplitude of a signal. In addition, a function of adjusting a ratio of effects may be provided to the signal processing portion 5.

The sound signal generated by the sound source may be: a musical sound signal output from an output terminal of an electronic musical instrument; a musical sound signal output from an output terminal of a music reproduction device such as an audio device, a portable music player, etc. The sound signal generated by the sound source may also be a signal representing sound generated in daily life or natural environment.

(8) The sound source may include both of a sound signal source and a vibration signal source. For example, in a case in which a player plays an instrument while singing, the microphone may acquire the sound signal representing the player's voice, while a pickup may acquire a vibration signal representing vibration generated by the instrument. Then, the sound signal and the vibration signal thus acquired may be output to the signal processing portion 5 which carries out processing of all types of effectors.

(9) The signal processing portion 5 may be provided to the microphone 2 or to the amplifier 6. Alternatively, the amplifier 6 may be provided to one of the transducers 10. Yet alternatively, the acoustic apparatus 1 may be integrated by providing the microphone 2 to the acoustic structure 9 while providing the signal processing portion 5 and the amplifier 6 to the transducer 10.

EXPLANATION OF THE REFERENCE SYMBOLS

1 Acoustic apparatus
2 Microphone
5 Signal processing portion
6 Amplifier
9 Acoustic structure
9*a* Acoustic structure main body
9*b* Front-side board surface
9*c* Slit group
9*e* Back-side board surface
9*f*1 to 9*f*10 Hollow members
9*g* Opening
9*h* Cavity
10 Transducer
11 Housing
12 Permanent magnet
13 Voice coil
14 Movable member

The invention claimed is:

1. An acoustic apparatus comprising:

a signal acquisition portion that acquires a sound signal generated by a sound source;

a signal processing portion that subjects the sound signal acquired by the signal acquisition portion to a predetermined signal processing;

a vibration generation portion that generates vibration corresponding to the sound signal acquired by the signal acquisition portion; and a planar shaped member that includes a plurality of cavities, and to which the vibration generated by the vibration generation portion is transmitted, wherein each cavity of the plurality of cavities comprises at least one opening on a front-side of the planar shaped member, wherein the vibration generated by the vibration generation portion is transmitted to a back-side of the planar shaped member, and wherein the plurality of cavities are different from each other in at least one of a relative position of the opening in a cavity with respect to the other cavities or a number of the openings.

2. The acoustic apparatus according to claim 1, wherein the vibration generation portion transmits the vibration to a position corresponding to a node of a vibration mode of the planar shaped member, on an outer face of the planar shaped member.

3. The acoustic apparatus according to claim 1, wherein the vibration generation portion transmits the vibration to a position corresponding to an antinode of a vibration mode of the planar shaped member, on an outer face of the planar shaped member.

4. The acoustic apparatus according to claim 1, wherein the predetermined signal processing extracts at least a part of a sound signal corresponding to a reflected sound component from the acquired sound signal, or generates a sound signal corresponding to the reflected sound component.

5. The acoustic apparatus according to claim 1, wherein the predetermined signal processing adjusts a ratio between a sound signal corresponding to a reflected sound component and a sound signal corresponding to a direct sound component, of the acquired sound signal.

6. The acoustic apparatus according to claim 1, wherein the predetermined signal processing adjusts a reverberation time period of reverberant sound composed of a reflected sound component of the acquired sound signal.

7. A vibration transmission method comprising:

acquiring a sound signal generated by a sound source;

subjecting the acquired sound signal to a predetermined signal processing;

generating vibration corresponding to the sound signal having been subjected to the predetermined signal processing; and transmitting the generated vibration to a planar shaped member that includes a plurality of cavities, wherein each cavity of the plurality of cavities comprises at least one opening on a front-side of the planar shaped member, wherein the generated vibration is transmitted to a back-side of the planar shaped member, and wherein the plurality of cavities are different from each other in at least one of a relative position of the opening in a cavity with respect to the other cavities or a number of the openings.

8. The vibration transmission method according to claim 7, wherein the vibration is transmitted to a position corresponding to a node of a vibration mode of the planar shaped member, on an outer face of the planar shaped member.

9. The vibration transmission method according to claim 7, wherein the vibration is transmitted to a position corresponding to an antinode of a vibration mode of the planar shaped member, on an outer face of the planar shaped member.

10. The vibration transmission method according to claim 7, wherein the predetermined signal processing extracts at least a part of a sound signal corresponding to a reflected sound component from the acquired sound signal, or generates a sound signal corresponding to the reflected sound component.

11. The vibration transmission method according to claim 7, wherein the predetermined signal processing adjusts a ratio between a sound signal corresponding to a reflected sound component and a sound signal corresponding to a direct sound component, of the acquired sound signal.

12. The vibration transmission method according to claim 7, wherein the predetermined signal processing adjusts a reverberation time period of reverberant sound composed of a reflected sound component of the acquired sound signal.

* * * * *